US006484846B1

(12) United States Patent
Parker

(10) Patent No.: US 6,484,846 B1
(45) Date of Patent: Nov. 26, 2002

(54) COMPRESSOR OIL PICK-UP TUBE

(75) Inventor: William A. Parker, Greenville, SC (US)

(73) Assignee: White Consolidated Industries, Inc., Cleveland, OH (US)

( * ) Notice: Subject to any disclaimer, the term of this patent is extended or adjusted under 35 U.S.C. 154(b) by 86 days.

(21) Appl. No.: 09/696,311

(22) Filed: Oct. 25, 2000

(51) Int. Cl.[7] ..... F01M 1/00
(52) U.S. Cl. ..... 184/6.16; 418/94
(58) Field of Search ..... 184/6.16, 6.18; 418/94

(56) References Cited

U.S. PATENT DOCUMENTS

| | | | | |
|---|---|---|---|---|
| 2,738,919 | A | | 3/1956 | Rusch et al. |
| 2,835,437 | A | | 5/1958 | Boynton |
| 2,935,244 | A | | 5/1960 | Dills |
| 3,545,891 | A | | 12/1970 | Parker |
| 3,664,461 | A | | 5/1972 | Leffers et al. |
| 3,858,685 | A | | 1/1975 | Bono |
| 4,086,033 | A | | 4/1978 | Stephan |
| 4,097,185 | A | | 6/1978 | Wolf |
| 4,209,080 | A | | 6/1980 | Douglas |
| 4,406,594 | A | | 9/1983 | Smaby et al. |
| 4,865,527 | A | | 9/1989 | Piera et al. |
| 4,907,951 | A | | 3/1990 | Wisner |
| 5,088,579 | A | | 2/1992 | Kim et al. |
| 5,377,781 | A | | 1/1995 | Yun |
| 5,733,108 | A | | 3/1998 | Riffe |
| 5,785,151 | A | | 7/1998 | Fry et al. |
| 5,795,140 | A | | 8/1998 | Jin |
| 5,803,718 | A | | 9/1998 | Woo |
| 5,884,727 | A | * | 3/1999 | Ryu ..... 184/6.3 |
| 6,171,090 | B1 | * | 1/2001 | Hurley ..... 418/94 |
| 6,182,794 | B1 | * | 2/2001 | Lee ..... 184/6.18 |

* cited by examiner

*Primary Examiner*—David A. Bucci
*Assistant Examiner*—Timothy McAnulty
(74) *Attorney, Agent, or Firm*—Pearne & Gordon LLP

(57) ABSTRACT

A hermetically sealed motor compressor comprising a housing enclosing a motor stator and rotor. A vertically oriented crankshaft is connected at one end to the rotor and has an offset crankshaft journal at its other end. An oil passage is provided in the journal and an oil pick-up tube has a first straight end projecting into an oil sump. The second straight end portion is axially aligned with the rotation axis of the crankshaft. A helically twisted insert is provided in the second straight end portion and the first and second portions are connected by an S-shaped intermediate portion.

10 Claims, 5 Drawing Sheets

COMPRESSOR OIL PICK-UP TUBE

BACKGROUND OF THE INVENTION

This invention relates to hermetically sealed compressors and, more particularly, to an improved oil pick-up tube for such compressors.

Compressors used in domestic and commercial refrigeration applications generally employ vertically arranged eccentric crank pins having one end connected to the rotor of an electric motor and a crank journal end driving a compressor piston. The compressor has a hermetically sealed housing, which provides a sump for lubricating oil at its lower end. Lubricating oil is conducted from the sump to machine elements requiring lubrication by a pick-up tube usually connected to a passage in the crank journal and extending into the oil sump. Since the crank journal is offset from the rotational axis of the motor, the pick-up tube enters the oil sump at an angle with its distal end intersecting the rotational axis. This arrangement pumps the oil by the centrifugal force created by the offset. However, considerable turbulence and splash noise is created by the angularity of the tube as where it enters the surface of the oil. Examples of slant pick-up tube arrangements may be found in U.S. Pat. Nos. 2,738,919; 3,545,891; 5,377,781; and 5,795,140.

Other slant pick-up tube arrangements employ an oil clip having a longitudinal slit, which is intended to separate the refrigerant from the oil. These arrangements tend to pick up high amounts of refrigerants at the surface of the sump and create considerable noise by oil splashing. Examples of such arrangements may be found in U.S. Pat. Nos. 3,858,685 and 5,085,579.

It is desirable to provide an oil pick-up tube which substantially eliminates oil-splash noise while providing an effective oil pump to deliver lubricating oil to the bearing surfaces of the compressor. It is also desirable to provide an oil pick-up tube which reduces the amount of refrigerant and, therefore, the amount of oil delivered to the bearing surfaces.

SUMMARY OF THE INVENTION

This invention relates to an oil pick-up tube which reduces oil splash noise and transient sound emissions while delivering a proper amount of lubricating oil to the bearing surfaces of a compressor.

More specifically, the invention relates to an oil pick-up tube for a hermetically sealed compressor. The compressor comprises a housing defining an oil sump and housing an electric motor. The motor has a stator and a rotor with the rotor connected to one end of a vertically oriented crankshaft. An offset crankshaft journal is provided at the other end of the crankshaft which is received by a connecting rod pinned to a compressor piston. The piston is received in a compressor cylinder. An oil passage is provided in the crankshaft journal and communicates with bearing surfaces in the compressor.

The oil pick-up tube has a first end portion in fluid communication with the oil passage in the crankshaft journal and has a second straight end portion projecting through a surface portion of a body of lubricating oil in the sump. The second straight end portion is axially aligned with the vertical rotation axis of the crankshaft. An S-shaped midportion connects the first and second end portions. The second straight end portion has a helically twisted fin inserted therein with a press fit. Since the second end portion rotates about its own axis, the twisted insert acts as a screw pump to conduct oil through the second end portion to the S-shaped midportion. Centrifugal force caused by the offset of the crankshaft journal pumps oil into the journal and to the bearing surfaces.

Preferably the first end portion of the tube is straight and is inserted in the oil passage of the crankshaft journal with a press fit. A radial flange is provided on the tube to limit the amount of tube inserted in the passage and properly locate the second straight end portion relative to the oil sump.

DETAILED DESCRIPTION OF THE INVENTION

Figure 1:
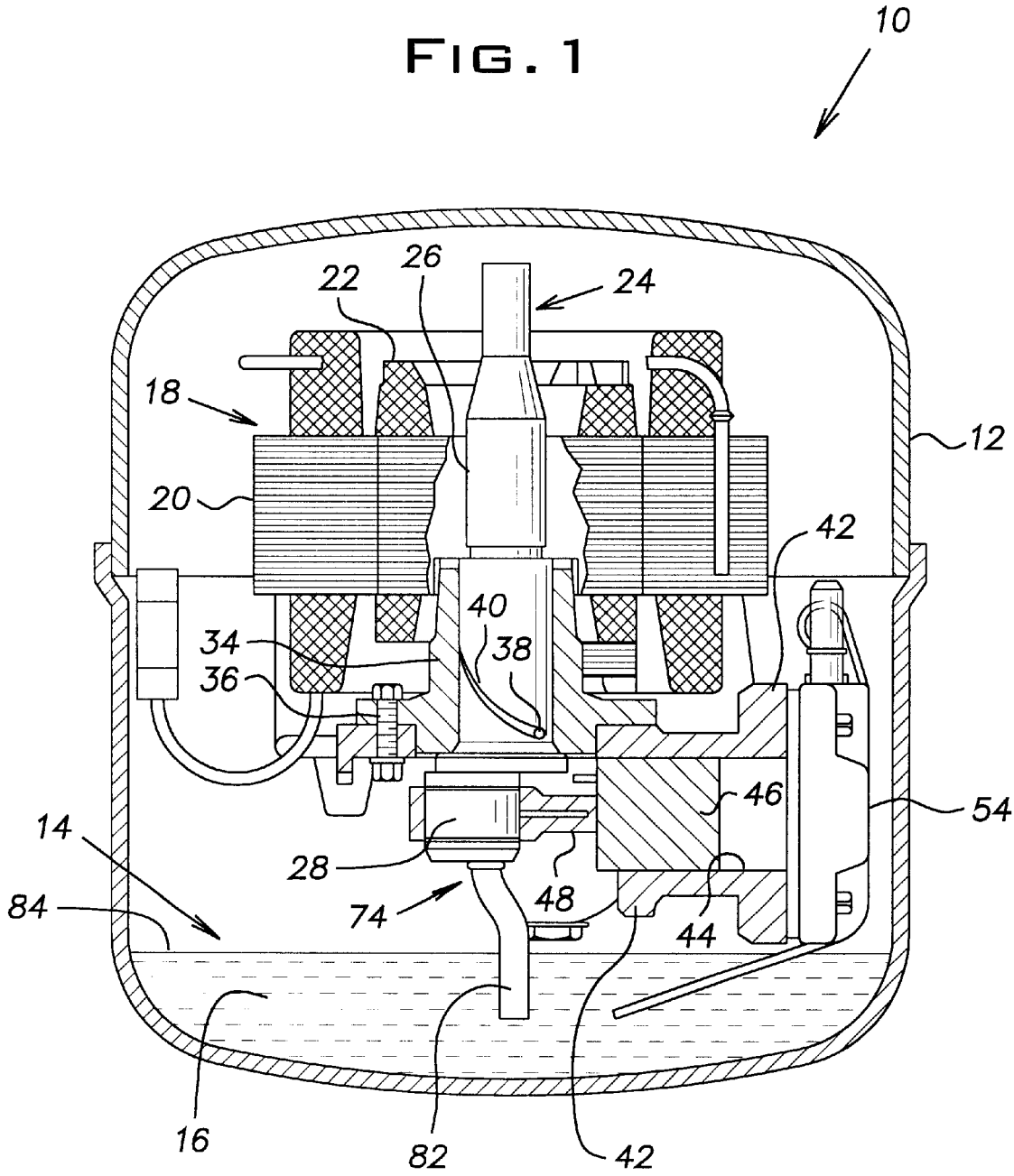
FIG. 1 is a cross-sectional view of a compressor according to this invention.
Figure 2:
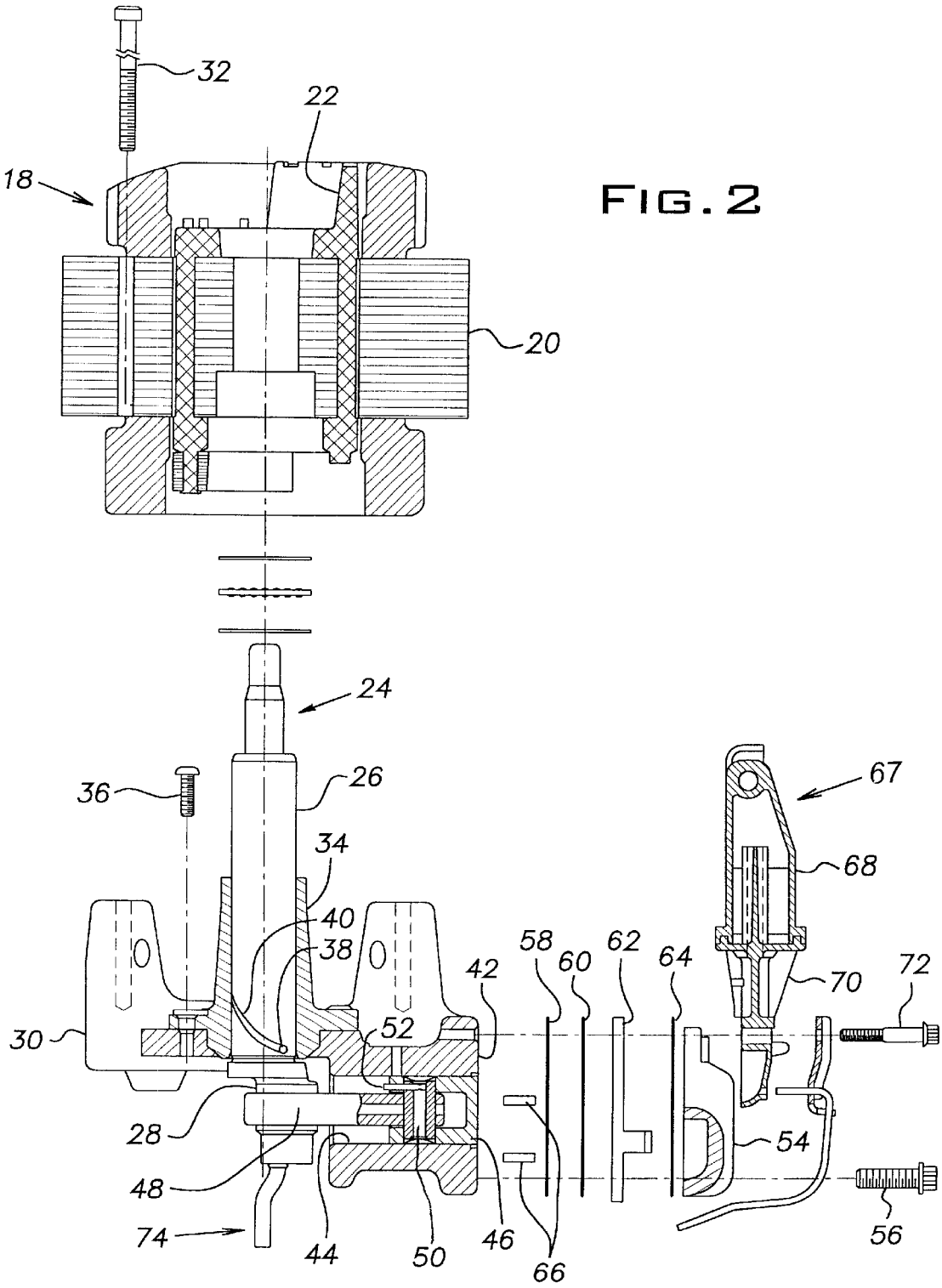
FIG. 2 is an exploded view of a portion of the compressor.

Referring now to the drawings and particularly to FIG. 1, there is illustrated a hermetically sealed compressor 10 having a sealed housing 12 defining an oil sump 14. A body of lubricating oil 16 is contained within the sump 14. The compressor further comprises an electric motor 18 having a stator 20 and a rotor 22.

A vertically oriented crankshaft 24 has one end 26 connected the rotor 22 and has an offset crankshaft journal 28.

The stator 20 is mounted on a crankcase 30 by stator bolts 32. Also mounted on the crankcase 30 is a bearing plate 34 fixed to the crankcase 30 by bolts 36. The crankshaft 26 is rotatably received in the bearing plate 34 and has an oil port 38 communicating with a spiral groove 40 provided at the interface between the crankshaft 26 and the bearing plate 34.

A cylinder block 42 is formed in the crankcase 30 and has a cylinder bore 44 which slideably receives a piston 46. The piston 46 is pivotably connected to a connecting rod 48 by a piston pin 50 which extends through the rod 48 and the piston 46 and is fixed thereto by a spring pin 52. The other end of the connecting rod 48 has an eye which is rotatably mounted on the crankshaft journal 28.

The cylinder 44 is closed by a cylinder head 54 which is fastened to the cylinder block 42 by screws 56 and which captures a valve plate gasket 58, a suction valve reed 60, a valve plate 62, and a compressor head gasket 64 against the cylinder block 42. To assist in the assembly, locator pins 66 are provided. Also associated with the cylinder head 54 is a suction muffler 67 which includes a muffler body 68 and a muffler base 70 and which is fastened to the cylinder block 42 by a muffler bracket screw 72 which extends through the cylinder head 42.

The entire compressor assembly is mounted in the housing by mounting springs (not shown) to minimize noise and vibration.

Figure 3:
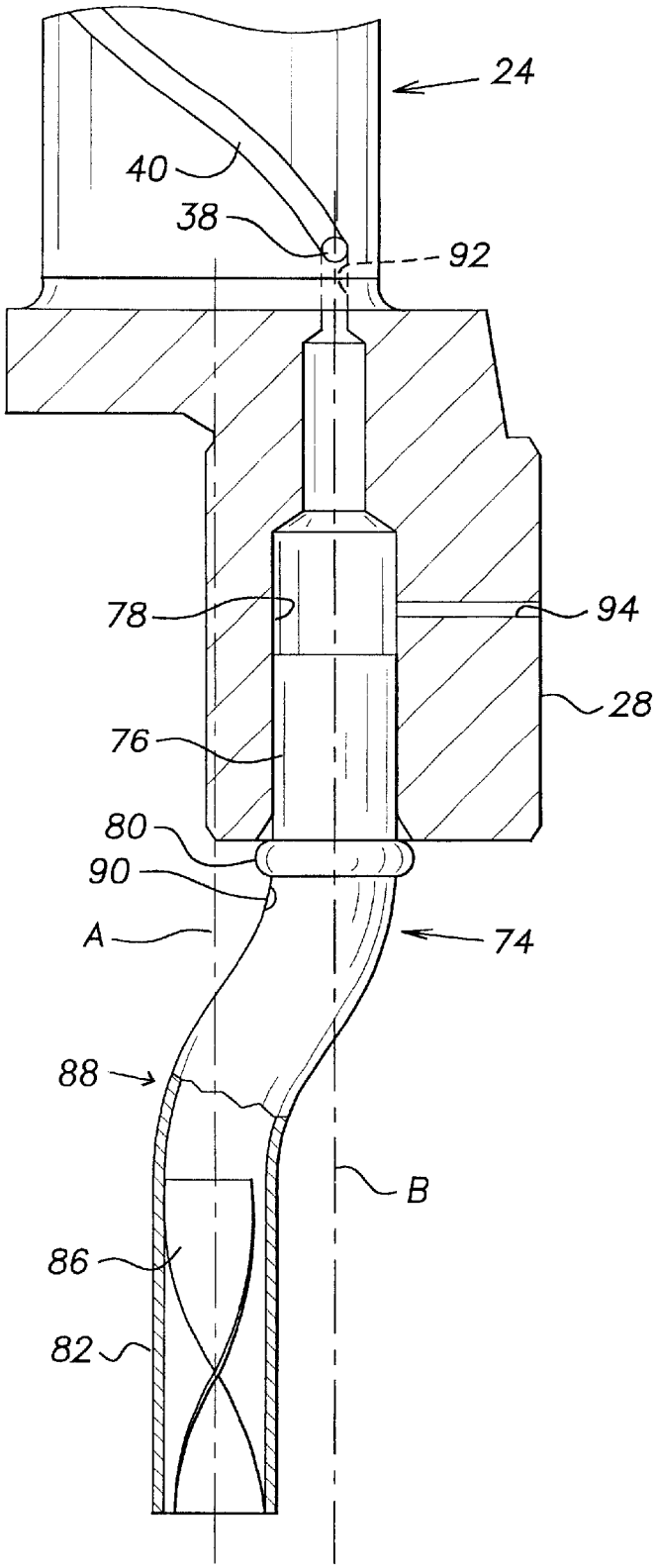
FIG. 3 is an elevational view, partly in section, of the crank journal and an oil pick-up tube according to the invention.
Figure 5:
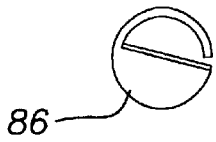
FIG. 5 is a top plan view of the spiral insert.
Figure 4:
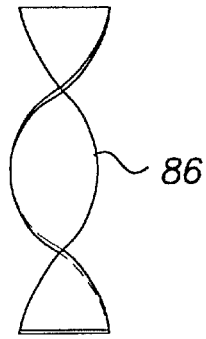
FIG. 4 is an elevational view of a spiral insert for the oil pick-up tube.

Referring now to FIGS. 3–5, there is illustrated an oil pick-up tube 74 according to this invention. The tube 74 is S-shaped and has a first straight end portion 76 inserted with an interference or press fit in an oil passage 78 in the crankshaft journal 28. A radial flange 80 is provided adjacent one end of the first straight end portion 76 to properly locate the portion 76 relative to the passage 78 and the surface of the oil sump.

The oil pick-up tube 74 has a second straight end portion 82 projecting through a surface portion 84 of the body of lubricating oil 16 in the sump 14. The second straight end portion 82 is axially aligned with a vertical rotation axis A. It may be noted that the axis A is parallel to and spaced from an axis B of the first straight end portion 76 and the oil passage 78.

A helically twisted fin 86 is inserted within the second straight end portion 82 to a position adjacent the upper end of the portion 82 and adjacent an S-shaped midportion 88 of the tube 74. A refrigerant vent opening 90 is provided in the tube 74 adjacent the flange 80.

In operation the second end portion 82 of the tube 74 is rotated about its own axis A so that the helically twisted fin 86 acts like a screw conveyor to draw lubricating oil from the sump 14 to the midportion 88 of the tube 74. Since the axis B is orbiting the axis A, centrifugal force causes the oil to flow into the oil passage 78. From the passage 78 oil flows through a passage 92, the oil port 38 and along the spiral groove 40 to lubricate the interface between the crankshaft 24 and the bearing plate. A cross passage 94 supplies lubricant to the crankshaft journal 28.

Figure 6:
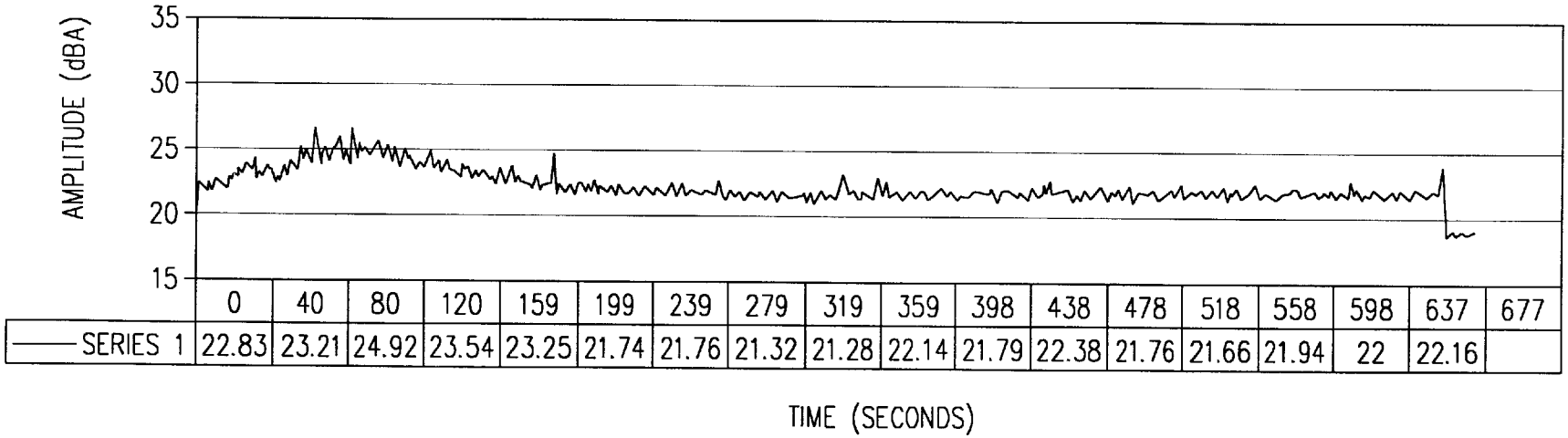
FIG. 6 is a graph showing the noise level, as a function of time, of a compressor having a conventional prior art oil pick-up tube.
Figure 7:
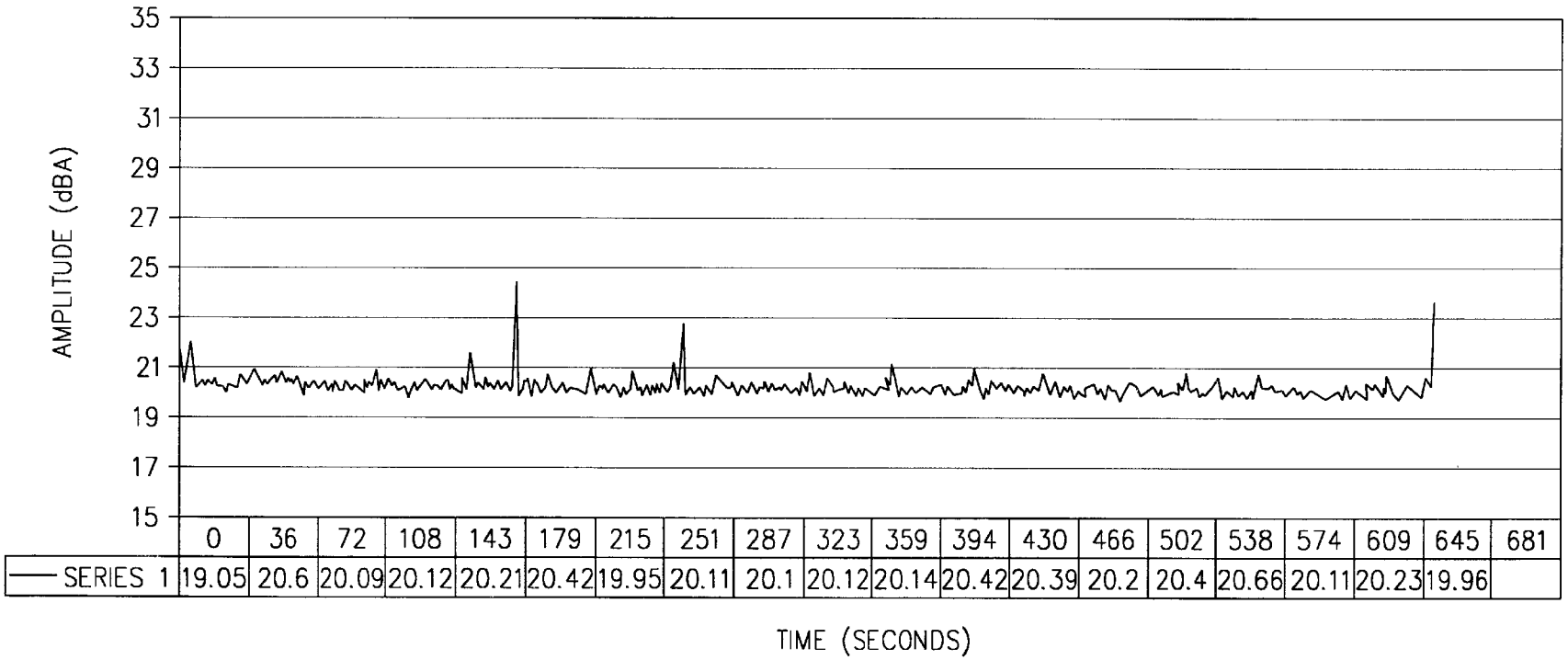
FIG. 7 is a graph showing the noise level, as a function of time, of a compressor having an oil pick-up tube according to this invention.

Since the straight end 82 is turning about its own axis A, little, if any, turbulence occurs in the sump 14 as compared to prior art oil pick-up tubes which enter the surface of the oil at an angle. This is illustrated by comparing the transient noise tests displayed in FIGS. 6 and 7. In FIG. 6, the transient noise test was conducted on a refrigerator compressor having a prior art oil pick-up clip and FIG. 7 illustrates transient noise in an identical compressor having a pick-up tube according to the invention. It may be noted that the present invention results in a substantially uniform output of about 20 dBA while the prior art output is over 21 dBA and as high as 25 dBA on startup.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A hermetically-sealed motor compressor comprising a housing enclosing a motor stator and rotor, a vertically oriented crankshaft connected at one end to said rotor stator and having an offset crankshaft journal at another end, said crankshaft journal having an oil passage therein, an oil pick-up tube having a first end portion in fluid communication with said oil passage and a second straight end portion projecting through a surface portion of a bodyofoil in an oil sump within said housing and into said body of oil, said first end portion being offset from a vertical rotation axis of said crankshaft, said second straight end portion being aligned with said vertical rotation axis of said crankshaft, said pick-up tube having a midportion connecting said first end portion with said second straight end portion, and means within said second straight end portion to pump oil upwardly to said midportion upon rotation of said crankshaft, whereby centrifugal force forces oil in said midportion upwardly to said portion.

2. A compressor according to claim 1, wherein said means to pump oil upwardly is a helically twisted fin insert.

3. A compressor according to claim 2 wherein said insert is press fitted within said second straight end portion.

4. A compressor according to claim 3 wherein said first end portion is straight and is inserted with a press fit within said oil passage and is provided with a radial flange to limit the amount of tube inserted in said passage and properly locate the second straight end portion relative to said oil sump.

5. A compressor according to claim 4 wherein a refrigerant vent opening is provided in said tube adjacent said flange.

6. A hermetically-sealed compressor comprising a housing defining an oil sump, a body of oil within said sump, an electric motor within said housing having a rotor and a stator, a vertically oriented crankshaft connected at one end to said rotor and having an offset crankshaft journal at another end, a connecting rod receiving said crankshaft journal at one end and being pinned to a compressor piston at another end, said piston being received in a compressor cylinder, said crankshaft journal having an oil passage therein, an oil pick-up tube having a first end portion in fluid communication with said oil passage and a second straight end portion projecting through a surface portion of said body of oil and into said body of oil, said first end portion being offset from a vertical rotation axis of said crankshaft, said second straight end portion being axially aligned with said vertical rotation axis of said crankshaft, said pick-up tube having a midportion connecting said first end portion with said second straight end portion, and means within said second straight end portion to pump oil upwardly to said midportion upon rotation of said crankshaft, whereby centrifugal force forces oil in said midportion upwardly to said oil passage.

7. A compressor according to claim 6 wherein said means to pump oil upwardly is a helically twisted fin insert.

8. A compressor according to claim 7 wherein said insert is press fitted within said second straight end portion.

9. A compressor according to claim 8 wherein said first end portion is straight and is inserted with a press fit within said oil passage and is provided with a radial flange to limit the amount of tube inserted in said passage and properly locate the second straight end portion relative to said oil sump.

10. A compressor according to claim 9 wherein a refrigerant vent opening is provided in said tube adjacent said flange.

* * * * *

UNITED STATES PATENT AND TRADEMARK OFFICE

CERTIFICATE OF CORRECTION

PATENT NO. : 6,484,846 B1
DATED : November 26, 2002
INVENTOR(S) : William A. Parker It is certified that error appears in the above-identified patent and that said Letters Patent is hereby corrected as shown below:

Column 4,
Line 1, please delete “bodyofoil”, and insert therefor -- body of oil --.

Signed and Sealed this

Fourth Day of March, 2003

JAMES E. ROGAN
*Director of the United States Patent and Trademark Office*